US012359288B2

(12) United States Patent
Kasahara et al.

(10) Patent No.: US 12,359,288 B2
(45) Date of Patent: Jul. 15, 2025

(54) METAL WIRE

(71) Applicant: Panasonic Intellectual Property Management Co., Ltd., Osaka (JP)

(72) Inventors: Akitoshi Kasahara, Osaka (JP); Naoki Kohyama, Osaka (JP); Tomohiro Kanazawa, Osaka (JP); Kenshi Tsuji, Osaka (JP); Yoshiyuki Kita, Osaka (JP); Atsushi Shimada, Osaka (JP); Yuuki Sasagawa, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 513 days.

(21) Appl. No.: 17/781,617

(22) PCT Filed: Dec. 4, 2020

(86) PCT No.: PCT/JP2020/045159
§ 371 (c)(1),
(2) Date: Jun. 1, 2022

(87) PCT Pub. No.: WO2021/117617
PCT Pub. Date: Jun. 17, 2021

(65) Prior Publication Data

US 2023/0002867 A1 Jan. 5, 2023

(30) Foreign Application Priority Data

Dec. 13, 2019 (JP) ..... 2019-225280

(51) Int. Cl.
*C22C 27/04* (2006.01)

(52) U.S. Cl.
CPC ..... *C22C 27/04* (2013.01)

(58) Field of Classification Search
CPC ..... C22C 27/04; C25D 7/0607; B21C 31/045; B21C 31/047; C25F 3/26
See application file for complete search history.

(56) References Cited

U.S. PATENT DOCUMENTS

| | | | | |
|---|---|---|---|---|
| 10,723,042 | B2 * | 7/2020 | Kanazawa | B28D 5/045 |
| 11,761,065 | B2 * | 9/2023 | Kanazawa | A61L 31/022 428/606 |
| 2007/0051900 | A1 | 3/2007 | Ward | |
| 2011/0319931 | A1 | 12/2011 | Esaki | |
| 2019/0232404 | A1 | 8/2019 | Kanazawa et al. | |

FOREIGN PATENT DOCUMENTS

| | | | |
|---|---|---|---|
| CN | 101696980 | A | 4/2010 |
| CN | 202984332 | | 6/2013 |
| CN | 104975316 | | 10/2015 |
| JP | 63-9111 | | 1/1988 |
| JP | 63-93847 | | 4/1988 |
| JP | 3-249156 | | 11/1991 |
| JP | 2006-16696 | | 1/2006 |
| JP | 2008-155053 | | 7/2008 |
| JP | 2018-181680 | | 11/2018 |
| JP | 2019-131841 | | 8/2019 |
| KR | 10-2005-0024829 | | 3/2005 |
| KR | 10-1254894 | B1 | 4/2013 |
| TW | 201936939 | | 9/2019 |
| WO | 2007/067310 | A2 | 6/2007 |
| WO | 2010/100808 | | 9/2010 |

OTHER PUBLICATIONS

"Doping", www.ibu-tec.com, 2025, https://www.ibu-tec.com/expertise/processes/doping/ (Mar. 6, 2025).*
India Official Action received in Application No. 202217030039, dated Sep. 14, 2022.
"Tungsten and Molybdenum Technical Data (the revised third edition)", Tungsten & Molybdenum Industries Association, Feb. 25, 2009, pp. 116-117 and partial English translation.
International Search Report issued in International Patent Application No. PCT/JP2020/045159, dated Feb. 9, 2021, along with an English translation thereof.
China Office Action and Search Report issued in CN Application No. 202080081614.0, dated Sep. 22, 2023.
Japan, Notice of Refusal received in JP Application No. 2004-002817, dated Sep. 10, 2024.
Japan, Notice of Refusal received in JP Application No. 2024-002817, dated Sep. 10, 2024, and English language translation thereof.

* cited by examiner

*Primary Examiner* — Jessee R Roe
(74) *Attorney, Agent, or Firm* — GREENBLUM & BERNSTEIN, P.L.C.

(57) ABSTRACT

A metal wire, which is one of a tungsten wire and a tungsten alloy wire, includes alkali metal on the surface thereof. The amount of alkali metal is at most 2.0 μg per 1 g of the metal wire.

12 Claims, 7 Drawing Sheets

METAL WIRE

TECHNICAL FIELD

The present invention relates to a metal wire.

BACKGROUND ART

Products using tungsten, which has properties such as high melting point and high hardness, are conventionally known. For example, Patent Literature (PTL) 1 discloses that a rhenium-tungsten alloy wire is used as a medical needle.

CITATION LIST

Patent Literature

[PTL 1] International Publication No. 2010/100808

Non Patent Literature

[NPL 1] "Tungsten and Molybdenum Technical Data", the revised third edition, Japan, Tungsten & Molybdenum Industries Association, Feb. 25, 2009, p.116

SUMMARY OF INVENTION

Technical Problem

Metal wires such as rhenium-tungsten alloy wires are generally wound around bobbins or the like and stored before being processed into medical needles. The longer the storage period, the more the surface of the metal wire oxidizes, causing the metal wires to stick to each other (see, for example, Non Patent Literature (NPL) 1). For that reason, stress is caused on the metal wire when the metal wire is drawn out from the bobbin, which is likely to result in wire deformation or wire breakage.

In view of the above, an object of the present invention is to provide a metal wire with less possibility of occurrence of wire deformation or wire breakage.

Solution to Problem

In order to achieve the above-described object, a metal wire according to an aspect of the present invention is one of a tungsten wire and a tungsten alloy wire, in which an amount of alkali metal present on a surface of the metal wire is at most 2.0 μg per 1 g of the metal wire.

ADVANTAGEOUS EFFECTS OF INVENTION

With the present invention, it is possible to provide a metal wire with less possibility of occurrence of wire deformation and wire breakage.

DESCRIPTION OF EMBODIMENTS

Figure 1:
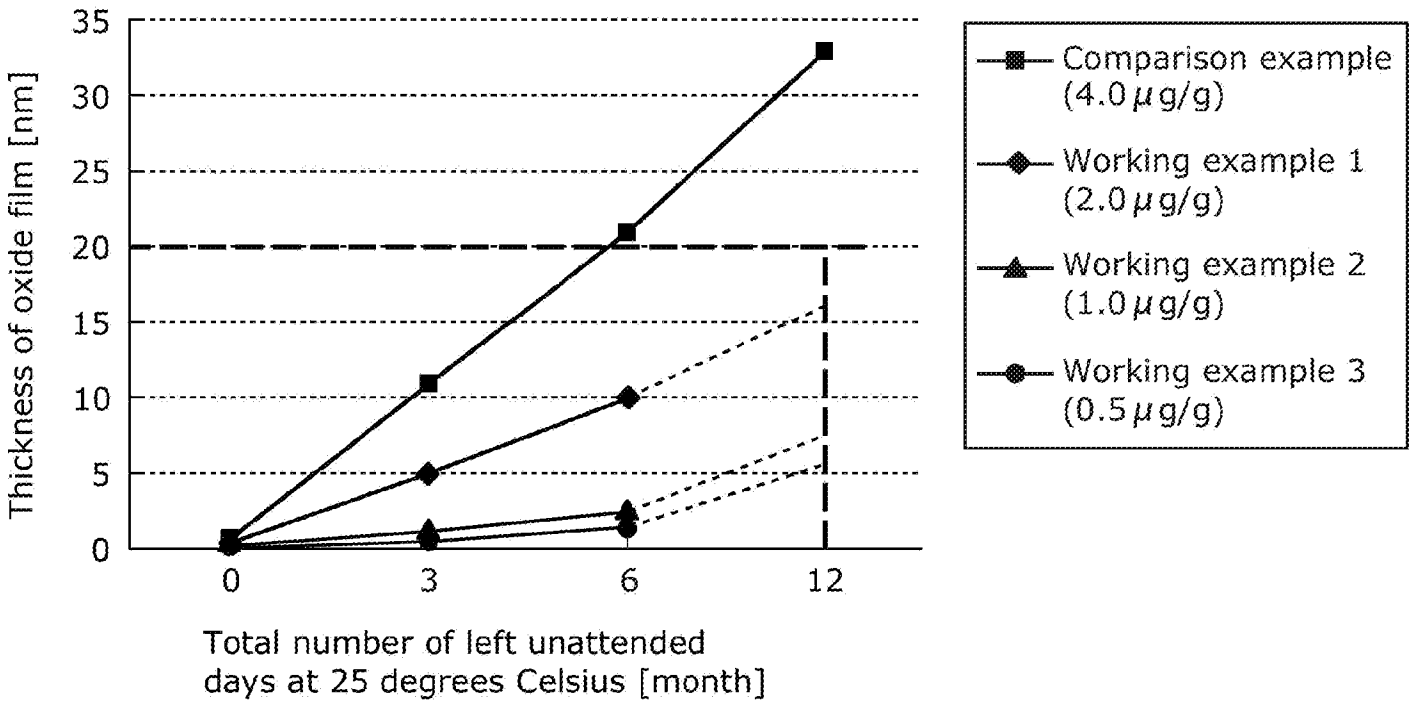
FIG. 1 is a graph indicating the relationship between the thickness of an oxide film formed on the surface of a metal wire according to an embodiment and a total number of days the metal wire is left unattended, for each predetermined amount of alkali metal present on the surface.

The following describes in detail a metal wire according to an embodiment of the present invention, with reference to the drawings. It should be noted that each of the embodiments described below shows a specific example of the present invention. As such, the numerical values, shapes, materials, structural components, the arrangement and connection of the structural components, steps, the processing order of the steps, and so on, shown in the following embodiments are mere examples, and therefore do not limit the present invention. Among the structural components in the embodiments described below, those not recited in the independent claims will be described as optional structural components.

In addition, each diagram is a schematic diagram and not necessarily strictly illustrated. Accordingly, for example, scale sizes, etc. are not necessarily exactly represented. In each of the diagrams, substantially the same structural components are assigned with the same reference signs, and redundant descriptions will be omitted or simplified.

EMBODIMENT

Metal Wire

First, the following describes a configuration of a metal wire according to an embodiment.

A metal wire according to the present embodiment is a tungsten wire or a tungsten alloy wire. In other words, the metal wire is a metal wire which contains tungsten (W) in major proportions. A tungsten content of the metal wire is, for example, at least 90 wt %. Here, a content is the ratio of a mass of a metal element (for example, tungsten) to a mass of a metal wire. The tungsten content may be at least 95 wt %, at least 99 wt %, or at least 99.9 wt %.

The tungsten wire is a pure tungsten wire including pure tungsten, or a doped tungsten wire including tungsten doped with an element other than tungsten. It should be noted that, in the present Specification, pure tungsten means that the tungsten content is at least 99.95 wt %. The pure tungsten wire contains inevitable impurities.

The element added as a dopant in a doped tungsten wire (hereinafter referred to as a dopant element) is, for example, potassium (K), but it may be thorium (Th) or cerium (Ce). The potassium content is, for example, at most 0.01 wt %. At this time, the potassium content may be at least 0.003 wt %. In addition, the potassium content may be at least 0.005 wt % or at most 0.005 wt %.

A dopant element (e.g., potassium) is present in a grain boundary of tungsten. In other words, the majority of the dopant elements are present inside the metal wire. For that reason, in the method of measuring the amount of alkali metal present on the surface of the metal wire (details will be described later), the amount of dopant elements can be ignored practically.

A tungsten alloy wire is a metal wire including an alloy of tungsten and a metal element. The metal element used for alloying with tungsten (hereinafter referred to as an alloy element) is, for example, rhenium (Re). Alternatively, the alloy element may be ruthenium (Ru), osmium (Os), or iridium (Ir). The tungsten alloy wire may contain only one type of alloy element or two or more types of alloy elements. The content of alloy elements in the tungsten alloy wire is, for example, at least 0.1 wt % and at most 10 wt %. Alternatively, the content of the alloy element may be at least 0.5 wt % and at most 5 wt %. As an example, the content of the alloy element is 1 wt %, but may be 3 wt %.

Alkali metal is present on the surface of the metal wire. The alkali metal is, for example, sodium (Na) or potassium. The alkali metal is a residual element that was contained in the solution used in the manufacturing of the metal wire, as described in detail later.

Although the details will be described later, the inventors of the present application have found through their investigations that the alkali metal present on the surface of the metal wire is a causal factor in the oxidation of the surface of the metal wire. In the metal wire according to the present embodiment, the amount of alkali metal present on the surface is less than or equal to a predetermined value, and thus oxidation of the surface of the metal wire is inhibited.

More specifically, the amount of alkali metal present on the surface of the metal wire is at most 2.0 μg per 1 g of the metal wire. The amount of alkali metal present on the surface of the metal wire may be at most 1.0 μg per 1 g of the metal wire. The amount of alkali metal present on the surface of the metal wire may be at most 0.5 μg per 1 g of the metal wire.

From the perspective of inhibiting oxidation between metal wires, it is more preferable if the amount of alkali metal present on the surface of the metal wire is smaller. However, it is difficult to make the amount of alkali metal present on the surface of the metal completely zero. In other words, the amount of alkali metal present on the surface of the metal wire is greater than 0.0 μg per 1 g of the metal wire. For example, the amount of alkali metal present on the surface of the metal wire may be at least 0.1 μg per 1 g of the metal wire.

The diameter of the metal wire is, for example, at most 40 μm. The diameter may be at most 30 μm, or at most 20 μm. For example, the diameter of the metal wire may be at most 15 μm, or at most 13 μm. The diameter of the metal wire may be at most 10 μm. The diameter of the metal wire may be as small as the process limitation. For example, the lower limit of the diameter of the metal wire may be at most 5 μm.

Wire deformation and wire breakage are more likely to occur as the diameter decreases, due to the stress generated in the metal wire when unsticking metal wires sticking to each other. It is thus expected that sticking is more inhibited as the diameter of the metal wire decreases.

Relationship between the Amount of Alkali Metal and Sticking between Metal Wires The following describes the relationship between the amount of alkali metal present on the surface of the metal wire according to the present embodiment and the sticking between the metal wires.

A metal wire that contains tungsten in major proportions is oxidized on the surface when stored in the air, forming an oxide film of tungsten on the surface. Metal wires are generally wound around bobbins or the like for storage. At this time, the surfaces of the metal wires are in close contact with each other. For that reason, the surfaces of the metal wires stick to each other when oxide films are formed on the surfaces. As described in NPL 1, in the case of ultrafine wires with a diameter of approximately 10 μm, the wires stick to each other due to oxidation to the extent that drawing out of the metal wires is impossible.

The inventors of the present application have conducted an investigation of the causal factors that cause oxidation of metal wires and the means to inhibit the oxidation. As a result, it has been found that alkali metal that is residual on the surface was most likely the causal factor of the oxidation.

FIG. 1 is a graph indicating the relationship between the thickness of an oxide film formed on the surface of a metal wire according to the present embodiment and a total number of days the metal wire is left unattended, for each predetermined amount of alkali metal present on the surface. In FIG. 1, the horizontal axis represents the total number of days the metal wire was left unattended in the room temperature environment (25 degrees Celsius), where the manufacturing date of the metal wire is day 0. The vertical axis represents the thickness of an oxide film of the metal wire. The thickness of the oxide film of the metal wire was measured by cutting the metal wire in a cross section perpendicular to the axial direction and checking the area in proximity to the surface with an electron microscope.

The comparison example, Working example 1, Working example 2, and Working example 3 indicated in FIG. 1 each have a different amount of alkali metal present on the surface per 1 g of the metal wire. More specifically, the amounts of alkali metal present on the surfaces are 4.0 μg, 2.0 μg, 1.0 μg, and 0.5 μg per 1 g of the metal wire for the comparison example, Working example 1, Working example 2, and Working example 3, respectively. The parameters of the comparison example and Working examples 1 to 3 other than the amount of alkali metal present on the surface are the same as each other. For example, the diameter of each of the comparison example and Working examples 1 to 3 is 16 μm. In addition, each of the comparison example and Working examples 1 to 3 is a doped tungsten wire doped with 60 ppm of potassium.

The manufacturing methods for the comparison example and Working examples 1 to 3 will be described later with referenced to FIG. 3. In addition, the method of measuring the amount of alkali metal present on the surface will be described later with referenced to FIG. 4.

As illustrated in FIG. 1, in the comparison example and Working examples 1 to 3, as the total number of days the metal wire is left unattended increases, the oxidation of the surface progresses and the thickness of the oxide film increases. It should be noted that, for each of Working examples 1 to 3, the thickness of the oxide film at the end of 12 months is an estimated value based on the thickness at the end of 12 months for the comparison example and the degree of increase in the thickness by the sixth month for each of Working examples 1 to 3.

As can be seen by comparing the comparison example with Working examples 1 to 3, as the amount of alkali metal present on the surface of the metal wire decreases, the oxide film is less likely to be formed. This is presumably based on the principle as described below.

Alkali metal is present as a hydroxide on the surface of the metal wire. The hydroxide of alkali metal has a hygroscopic property. Accordingly, when alkali metal (specifically, its hydroxide) is present on the surface of a metal wire, the alkali metal will easily absorb moisture from the air. This facilitates adherence of moisture to the surface of the metal wire, and a tungsten oxide is formed on the surface as a result of reaction between the adhered moisture and tungsten. The greater the amount of alkali metal, the greater the amount of moisture absorbed. As a result, the formation of tungsten oxide is facilitated and the thickness of the oxide film increases.

When the metal wires stick to each other, the thickness of the oxide film measured was 20 nm or more. More specifically, when the thickness of the oxide film was 20 nm or more, the metal wires stick to each other, and the frequency of wire deformation or wire breakage of the wire increased, inducing a decrease in yield. When the thickness of the oxide film was less than 20 nm, wire deformation or wire breakage almost never occurred.

In the comparison example, when the storage period exceeded six months, the thickness of the oxide film exceeded 20 nm, causing the sticking between the metal wires. This means that the product life of the comparison example is less than or equal to six months. Meanwhile, in Working examples 1 to 3, the thickness of the oxide film was 10 nm or less at the end of six months. For that reason, even at the end of 12 months, the thickness of the oxide film is estimated to be 20 nm or less, indicating that it is possible to store the metal wires without causing sticking between the metal wires more than twice as long as the comparison example. In other words, according to Working examples 1 to 3, it is possible to extend the product life more than twice as long as the comparison example.

Figure 2:
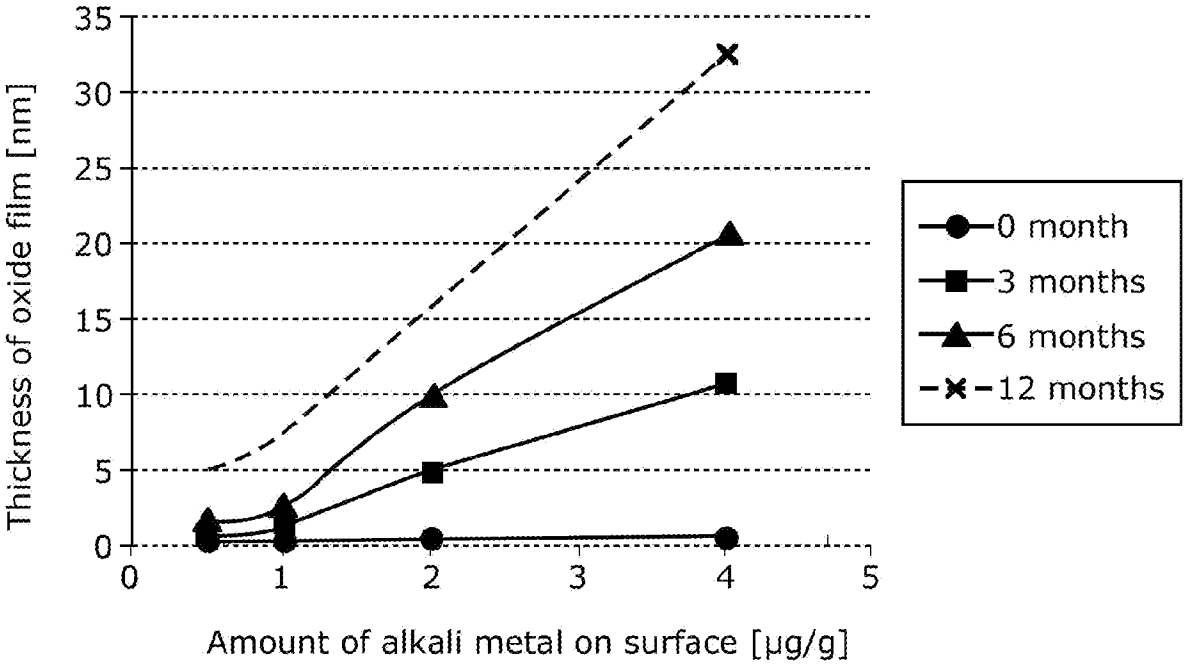
FIG. 2 is a graph indicating the relationship between the thickness of the oxide film formed on the surface of the metal wire according to the embodiment and the amount of alkali metal present on the surface, for each predetermined total number of days the metal wire is left unattended.

FIG. 2 is a graph indicating the relationship between the thickness of an oxide film formed on the surface of a metal wire according to the present embodiment and the amount of alkali metal present on the surface, for each predetermined total number of days the metal wire is left unattended. In FIG. 2, the horizontal axis represents the amount of alkali metal present on the surface of the metal wire. The vertical axis represents the thickness of an oxide film of the metal wire. FIG. 2 indicates a graph drawn using the same data as the graph in FIG. 1. Accordingly, in the graph with a storage period of 12 months, the plots with the amount of alkali metal of 0.5 μg, 1.0 μg, and 2.0 μg are estimated values.

As illustrated in FIG. 2, in the case of the amount of alkali metal per 1 g of the metal wire being 4.0 μg (comparison example), the amount of alkali metal doubled compared to the case of the amount of alkali metal being 2.0 μg (Working example 1), and the thickness of the oxide film also approximately doubled at each of the end of three months, the end of six months, and the end of twelve months. On the other hand, in the case of the amount of alkali metal per 1 g of the metal wire being 1.0 μg (Working example 2), the amount of alkali metal halved compared to the case of the amount of alkali metal being 2.0 μg (Working example 1), but the thickness of the oxide film was less than half at each of the end of three months, the end of six months, and the end of twelve months. In other words, as a result of adjusting the amount of alkali metal per 1 g of the metal wire to 1.0 μg or less, it is possible to further inhibit the oxidation of the surface.

As described above, as a result of setting the amount of alkali metal present on the surface of the metal wire to 2.0 μg or less, oxidation of the surface of the metal wire can be inhibited, and thus it is possible to inhibit sticking between the surfaces. As a result of setting the amount of alkali metal to 1.0 μg or less, it is possible to further inhibit sticking between the surfaces.

In the above-described comparison example and Working examples 1 to 3, doped tungsten wires doped with potassium have been indicated. However, it is possible to obtain the same tendency in any of: the case where the dopant element is other than potassium; the case of pure tungsten wires; and the case of tungsten alloy wires. This is because, in any of the cases, tungsten is included in major proportions, and thus an oxide film with tungsten is formed on the surface. In other words, it is sufficient if the amount of alkali metal present on the surface of the metal wire is 2.0 μg (alternatively 1.0 μg or 0.5 μg) or less per 1 g of the metal wire in any of: the case of the doped tungsten wire doped with a dopant element other than potassium; the case of pure tungsten wires; and the case of tungsten alloy wires. According to this configuration, in the same manner as the potassium doped tungsten wires, formation of an oxide film is inhibited, thereby inhibiting the metal wires from sticking to each other. Accordingly, it is possible to implement doped tungsten wires, pure tungsten wires, and tungsten alloy wires that are less likely to cause wire distortion or wire breakage.

Manufacturing Method

Next, a manufacturing method of the metal wire according to the present embodiment will be described with reference to FIG. 3. FIG. 3 is a flowchart illustrating the manufacturing method of the metal wire according to the present embodiment.

Figure 3:
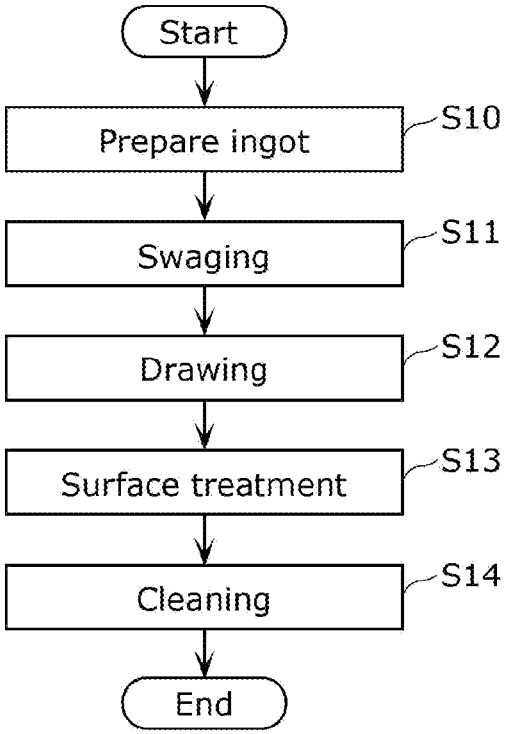
FIG. 3 is a flowchart illustrating a manufacturing method of the metal wire according to the embodiment.

As illustrated in FIG. 3, first, an ingot of tungsten or a tungsten alloy is prepared (S10). More specifically, an aggregation of pure tungsten powders or an aggregation of doped tungsten powders is prepared, or an aggregation of tungsten powders and alloy metal powders (for example, rhenium powders) is prepared. An ingot is produced by pressing and sintering the aggregation of powders. An average grain diameter of the respective tungsten powders is in a range of from at least 3 μm to at most 4 μm, for example.

Next, swaging processing is applied to the produced ingot (S11). More specifically, the ingot is press-forged from its periphery and extended to be a tungsten wire or a tungsten alloy wire each of which has a wire shape. It should be noted that the ingot may be subjected to rolling processing instead of the swaging processing.

For example, an ingot having a diameter of approximately at least 15 mm and approximately at most 25 mm is shaped into a tungsten wire or a tungsten alloy wire having a diameter of approximately 3 mm, by repeatedly applying the swaging processing to the ingot. Annealing is performed during the swaging processing to ensure workability in the subsequent processes. For example, annealing at 2400 degrees Celsius is performed in a diameter range of from at least 8 mm to at most 10 mm.

Next, drawing is performed on the tungsten wire or the tungsten alloy wire (S12). Specifically, first, the tungsten wire or the tungsten alloy wire is heated to form an oxide layer on the surface. For example, the tungsten wire or the tungsten alloy wire is directly heated using a burner or the like at a heating temperature of 900 degrees Celsius. As a result of the formation of an oxide layer on the surface, it is possible to inhibit the occurrence of wire breakage during the subsequent wire drawing process.

In the wire drawing process (S12), heat drawing of tungsten wire is performed using a single wire drawing die. In other words, the tungsten wire is drawn (rendered thinner)

while being heated. Heat drawing is repeatedly performed while changing the wire drawing die. The reduction rate in a cross-section area of the tungsten wire by one heat drawing using a single wire drawing die is, for example, at least 10% and at most 40%. In the heat drawing, a lubricant including graphite dispersed in water may be used.

In the repeating of heat drawing, a wire drawing die having a smaller pore diameter than a pore diameter of a wire drawing die used in the immediately-before heat drawing is used. As the number of repeating increases, the heating temperature is decreased. In other words, the heating temperature for heat drawing using a small wire drawing die is lower than the heating temperature for heat drawing using a large wire drawing die. Electrolysis may be performed in the middle stage of the repeating of heat drawing. As for the wire drawing die to be used, a carbide die is used for diameters up to 0.38 mm, a sintered diamond die is used for diameters in the range of from 0.38 mm to 0.18 mm, and a monocrystalline diamond die is used for diameters in the range of from 0.18 mm to 0.010 mm.

Subsequent to the wire drawing process, surface treatment is performed on the tungsten wire or the tungsten alloy wire (S13). The surface treatment is, for example, electrolytic polishing. More specifically, in a state in which the tungsten wire or tungsten alloy wire after the wire drawing process and the counter electrode are immersed into the electrolyte, a voltage is applied between the tungsten wire and the counter electrode. The electrolyte used for the electrolytic polishing is a solution containing an alkali metal element. For example, the electrolyte is a potassium hydroxide solution or a sodium hydroxide solution. The surface of the tungsten wire or the tungsten alloy wire is polished by the electrolytic polishing. As a result, it is possible to remove an oxide, graphite, etc. adhered to the surface.

Subsequent to the surface treatment, the surface of the tungsten wire or the tungsten alloy wire is cleaned (S14). By cleaning the surface, the residue from the surface treatment (S13) present on the surface of the tungsten wire or the tungsten alloy wire is washed off. More specifically, the tungsten wire or the tungsten alloy wire is cleaned as a result of being immersed in cleaning water for a predetermined period of time after the surface treatment.

The cleaning water may be not only pure water but also an acidic solution. For example, the cleaning water may be a solution containing hypochlorous acid, a solution containing acetic acid, or a solution containing hydrochloric acid.

The cleaning water is, for example, pure water containing a bubble, a microbubble, or a nanobubble (hereinafter referred to as bubble water). The microbubble or the nanobubble can be generated in pure water by a microbubble or nanobubble generator. Compared to pure water which does not contain either a microbubble or a nanobubble, bubble water has a higher cleaning power. For that reason, it is possible to reduce the amount of residue on the surface of the tungsten wire or the tungsten alloy wire.

It is possible to adjust the amount of alkali metal remaining on the surface of the metal wire, by adjusting the intensity of the bubbles (specifically, the amount of bubbles per unit volume of bubble water). More specifically, the cleaning power increases as a result of increasing the amount of bubbles, thereby enabling reduction in the amount of alkali metal remaining on the surface. For example, Working examples 1 to 3 illustrated in FIG. 1 are metal wires obtained by increasing the amount of bubbles in stated order. The comparison example is a metal wire obtained by cleaning using, as the cleaning water, pure water not containing bubbles. The metal wires of the comparison example and Working examples 1 to 3 differ from one another only in the cleaning process (S14), and are manufactured through the same processes other than the cleaning process.

Through the above-described processes, it is possible to manufacture a metal wire which is a tungsten wire or a tungsten alloy wire including a sufficiently reduced amount of alkali metal on the surface.

It should be noted that the surface treatment (S13) need not necessarily be electrolytic polishing. For example, the surface treatment may be a boiling treatment using a solution containing an alkali metal element. The solution for use in the boiling treatment is, for example, potassium hydroxide solution or sodium hydroxide solution in the same manner as the electrolytic solution.

In addition, in the cleaning process (S14), ultrasonic cleaning may be performed. More specifically, the tungsten wire or tungsten alloy wire after surface treatment may be immersed in cleaning water in which ultrasonic waves are generated by an ultrasonic generator (hereinafter referred to as ultrasonic cleaning water). For example, the cleaning power is increased by increasing the frequency or amplitude of ultrasonic waves. As a result, it is possible to reduce the amount of alkali metal remaining on the surface.

The bubble water or ultrasonic cleaning water used for cleaning is recovered and reused. In other words, the bubble water or ultrasonic cleaning water may be circulated. Alternatively, the bubble water or ultrasonic cleaning water may be used in a so-called single-use manner without being recovered. The single-use cleaning water does not contain a residue that has come off from the surface as a result of the cleaning, and thus is capable of providing increased cleaning power than the cleaning water that is circulated. In other words, it is possible to further reduce the amount of alkali metal present on the surface of the tungsten wire or tungsten alloy wire after cleaning.

Method of Measuring the Alkali Metal

Figure 4:
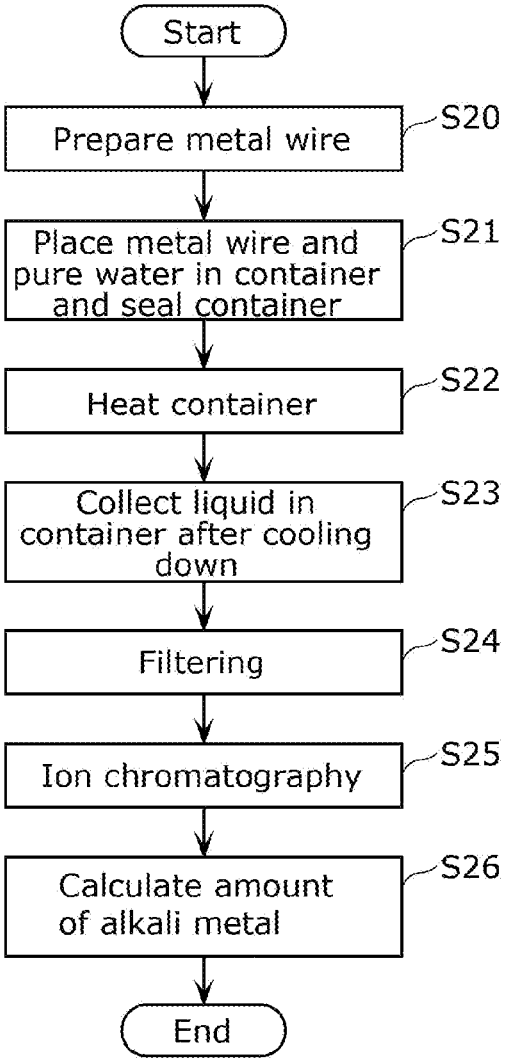
FIG. 4 is a flowchart illustrating the method of measuring the amount of alkali metal present on the surface of the metal wire according to the embodiment.

Next, a method of measuring the alkali metal present on the surface of the metal wire according to the present embodiment will be described with reference to FIG. 4. FIG. 4 is a flowchart illustrating the method of measuring the amount of alkali metal present on the surface of the metal wire according to the present embodiment.

As illustrated in FIG. 4, first, a metal wire to be measured is prepared (S20). More specifically, a metal wire is cut into a predetermined length, and the metal wire after the cutting is prepared as the metal wire to be measured. The mass of the metal wire to be measured is measured and recorded. It should be noted that the mass of the metal wire to be measured is not specifically limited. However, it is possible to facilitate the measurement with accuracy by setting the mass of the metal wire to be measured to approximately 5 g, for example.

Next, the metal wire to be measured and pure water are placed in a container and sealed (S21). The container is a polyethylene bag, for example. The pure water is 5 cc, for example. The air inside the container bag is removed as much as possible so as to prevent the container bag from bursting when the temperature is increased in the next process, and then the container bag is sealed.

Next, the container is heated (S22). More specifically, the sealed container bag in which the metal wire to be measured and pure water are placed is heated in boiling water for 60 minutes (heated by double-boiling). As a result, the hydroxide of alkali metal remaining on the surface of the metal wire to be measured is dissolved into the pure water in the container bag.

After stopping the heating and cooling down to the room temperature (e.g., 25 degrees Celsius), the liquid in the container is collected (S23). More specifically, 1 cc of liquid in the container is collected using a syringe with a needle, and filtering is performed so as to remove a solid mixed in the liquid (S24).

Next, ion chromatography is performed on 0.25 cc of the liquid after the filtering (S25). For example, the ion chromatography analyzer ICS-1100 manufactured by Dionex Corporation is used as an analyzer that performs ion chromatography. A Dionex IonPac CS12A column manufactured by Thermo Fisher Scientific Inc. is used as the cation-exchange column.

Next, the amount of alkali metal in the solution after the filtering is calculated (S26). More specifically, the peak area of the chart obtained by ion chromatography is compared with the peak area of the chart obtained by ion chromatography for the standard solution, thereby calculating the amount of alkali metal in the collected and filtered solution. The amount of alkali metal in the filtered solution is multiplied by the solution ratio (=the amount of prepared pure water/the amount of filtered solution), and the result of the multiplying is divided by the mass measured in step S20, thereby calculating the amount of alkali metal present on the surface of the metal wire per 1 g of the metal wire. In other words, X [unit: μg], which is the amount of alkali metal present on the surface of the metal wire per 1 g of the metal wire, is calculated based on the following equation (1).

$$X=Y\times(Va+Vb)\div Z \quad (1)$$

It should be noted that Y denotes the amount of alkali metal [unit: μg] obtained based on the peak area of the chart. Va denotes the amount of pure water [unit: cc] prepared in step S21. Vb denotes the amount of solution [unit: cc] that has been filtered in step S24. Z denotes the mass [unit: g] of the metal wire to be measured, as measured in step S20.

As the standard solution, for example, Cat.No.07197-96 Cation Mixed Standard Solution manufactured by KANTO CHEMICAL CO., INC. is used. It should be noted that the analyzer, column, and standard solution used in ion chromatography are not specifically limited.

Through the above-described processes, the amount of alkali metal on the surface of the metal wire can be measured.

In a doped tungsten wire, a dopant element (e.g., potassium) is present at the grain boundary as described above. In other words, the majority of the dopant elements are present inside the metal wire, and thus it can be presumed that the dopant elements do not dissolve in pure water during the heating process in step S22. It is possible to ignore the liquid collected in step S23, presuming that it contains virtually no dopant elements.

Use Example of Metal Wire

The following describes a use example of the metal wire according to the present embodiment.

Figure 5:
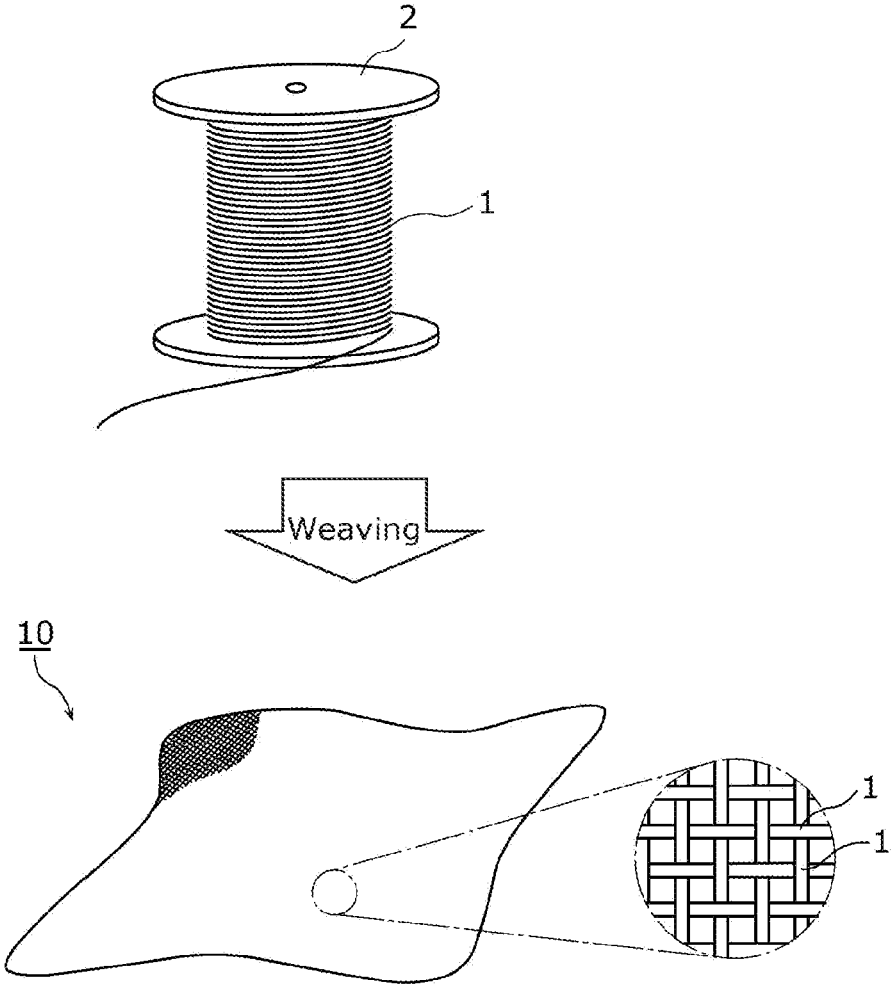
FIG. 5 is a perspective view illustrating the metal wire according to the embodiment and a metal mesh that is woven using the metal wire.

The metal wire according to the present embodiment can be used in a variety of applications. FIG. 5 is a perspective view illustrating metal wire 1 according to the present embodiment and metal mesh 10 woven using metal wire 1.

As illustrated in FIG. 5, metal wire 1 that has been manufactured is generally wound onto a bobbin (spool) 2 and stored. When an intended metal product is to be manufactured using metal wire 1, metal wire 1 is unwound from bobbin 2.

For example, metal mesh 10 can be manufactured by performing weaving using metal wire 1 as at least one of wefts or warps. Metal mesh 10 is an example of a tungsten product including metal wire 1, and is, for example, a screen mesh used for screen printing. As described above, metal wire 1 is used as a wire for a screen mesh. Metal mesh 10 may be used not only for a screen mesh but also for clothing such as gloves, socks, and jackets, for example.

An oxide film is less likely to be formed on the surface of metal wire 1, and thus it is possible to inhibit the occurrence of wire deformation or wire breakage at the time of removal from bobbin 2 and during weaving. In addition, when used as a screen mesh, it is also possible to inhibit the occurrence of wire breakage.

In addition, metal wire 1 may also be used for saw wires, medical device components (e.g., catheters), twisted wires, ropes, etc. Alternatively, metal wire 1 may be used for wires, filaments, etc. for electric spark machining. Metal wire 1 may be utilized as a single wire, or a plurality of metal wires 1 may be used by being twisted together or bundled together. It is possible to use metal wire 1 for various tungsten products that take advantage of the characteristics of tungsten such as high melting point and high hardness.

Figure 6:
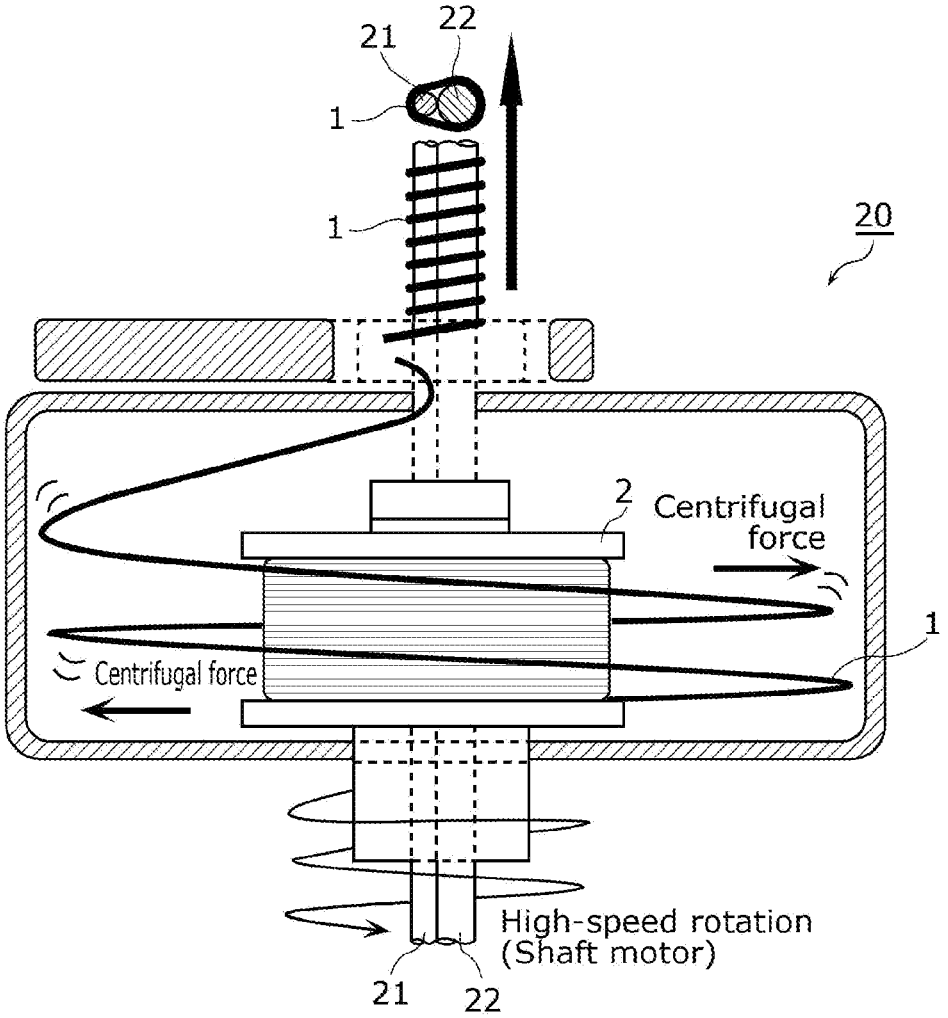
FIG. 6 is a schematic diagram illustrating a coiling process of a filament coil using the metal wire according to the embodiment.

FIG. 6 is a schematic diagram illustrating a coiling process of a filament coil using metal wire 1 according to the present embodiment. A filament coil is formed, for example, by using tungsten wire 21 and molybdenum wire 22 as a core wire, and performing covering with metal wire 1 around the core wire. For example, metal wire 1 which is a tungsten wire with a diameter of 20 μm is unwound at a rotation frequency of 20,000 rpm. As a result of being rotated at high speed by a shaft motor, metal wire 1 is unwound by centrifugal force and wound around the outer periphery surface of the core wire. Metal wire 1 is wound around the outer periphery surface of the core wire at equal intervals, as a result of moving the core wire in the axial direction at a constant speed.

At the time of this unwinding, sticking occurs when the tungsten surface is oxidized, causing wire deformation or wire breakage. With metal wire 1 according to the present embodiment, the oxidation of the surface is inhibited as described above, and thus it is possible to inhibit the occurrence of wire deformation or wire breakage.

Figure 7:
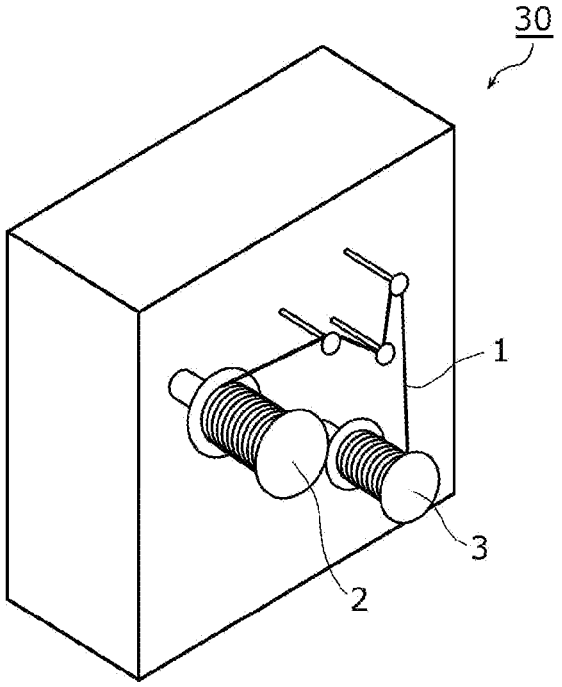
FIG. 7 is a perspective view illustrating a rewinding device of the metal wire according to the embodiment.

FIG. 7 is a perspective view illustrating rewinding device 30 for metal wire 1 according to the present embodiment. Rewinding device 30 rewinds metal wire 1 wound around bobbin 2 onto bobbin 3. It should be noted that rewinding device 30 may be an electrodeposition device that performs electrodeposition in addition to rewinding. In other words, metal wire 1 that has been unwound from bobbin 2 may be subjected to electrodeposition processing, and then wound onto bobbin 3. The electrodeposition processing is performed, for example, to attach an abrasive particle to the surface when metal wire 1 is used as a saw wire.

For example, when metal wire 1 is a tungsten wire for a saw wire, metal wire 1 having a diameter of 40 μm is unwound from bobbin 2 at a linear velocity of 800 m/minute at the maximum, during the rewinding or electrodeposition. At the time of unwinding, sticking occurs when the tungsten surface is oxidized, causing wire deformation or wire breakage. In addition, when wire deformation is caused, a saw wire is likely to jump to the next wire position in the work roller. In contrast, with metal wire 1 according to the present embodiment, the oxidation of the surface is inhibited as described above, and thus it is possible to inhibit the occurrence of wire deformation or wire breakage. It is also possible to inhibit the occurrence of wire position jumping when metal wire 1 is used as a saw wire.

Advantageous Effect, Etc.

As described above, a metal wire according to the present embodiment is: a metal wire that is one of a tungsten wire and a tungsten alloy wire, in which an amount of alkali metal present on a surface of the metal wire is at most 2.0 μg per 1 g of the metal wire.

According to this configuration, it is possible to inhibit the occurrence of wire deformation or wire breakage.

In addition, for example, the amount of alkali metal present on the surface of the metal wire is at most 1.0 μg per 1 g of the metal wire.

According to this configuration, it is possible to further inhibit the occurrence of wire deformation or wire breakage.

In addition, for example, the amount of alkali metal present on the surface of the metal wire is at most 0.5 μg per 1 g of the metal wire.

According to this configuration, it is possible to yet more inhibit the occurrence of wire deformation or wire breakage.

In addition, for example, a diameter of the metal wire is at most 40 μm. In addition, for example, a diameter of the metal wire may be at most 13 μm.

As described above, as the diameter of the tungsten wire decreases, it is more likely that wire deformation or wire breakage will occur when the surfaces stick to each other. Accordingly, it is possible to more effectively use the advantage of inhibiting sticking as a result of the surface being less likely to be oxidized. It should be noted that an ultrafine tungsten wire having a diameter of 40 μm or less has a high tensile strength and can be used for a variety of applications.

In addition, for example, the metal wire may be used as a core wire of a saw wire.

According to this configuration, wire deformation or wire breakage is less likely to occur during rewinding at the time of electrodeposition processing of abrasive particles. As a result, it is possible to apply electrodeposition processing uniformly on the surface of the metal wire. In addition, it is possible to inhibit the occurrence of wire position jumping when the metal wire is used as a saw wire.

In addition, for example, the metal wire may be used as a wire of a screen mesh.

According to this configuration, wire deformation or wire breakage is less likely to occur at the time of both weaving and use. As a result, the wire is more resistant to pressing by a squeegee or the like, making it possible to improve the accuracy of screen printing.

Others

Although the metal wire according to the present invention has been described based on the above-described embodiment, the present invention is not limited to the above-described embodiment.

For example, although the case where the metal wire is wound around a bobbin and stored is assumed in the above-described embodiment, the present invention is not limited to this case. A plurality of metal wires may be stored in a bundle. Alternatively, the metal wire may be stored in an environment in which the metal wire can stick to other metal wires or other objects. It should be noted that, even when the wire is not stored for a long period of time, the generation of an oxide film during use can be inhibited, for example, when the wire is used in an environment in which the wire is exposed to moisture. As a result, it is possible to inhibit the occurrence of wire breakage or wire deformation during use.

Additionally, embodiments arrived at by those skilled in the art making modifications to the above embodiment, as well as embodiments arrived at by combining various structural components and functions described in the above embodiment without materially departing from the novel teachings and advantages of the present invention are intended to be included within the scope of the present invention.

REFERENCE SIGNS LIST

1 metal wire
10 metal mesh

The invention claimed is:

1. A metal wire that is one of a tungsten wire and a tungsten alloy wire,
wherein a diameter of the metal wire is at least 5 μm, and
wherein an amount of alkali metal present on a surface of the metal wire is at least 0.1 μg per 1 g of the metal wire and at most 2.0 μg per 1 g of the metal wire.

2. The metal wire according to claim 1, wherein
the amount of alkali metal present on the surface of the metal wire is at most 1.0 μg per 1 g of the metal wire.

3. The metal wire according to claim 1, wherein
the amount of alkali metal present on the surface of the metal wire is at most 0.5 μg per 1 g of the metal wire.

4. The metal wire according to claim 1, wherein
the diameter of the metal wire is at most 40 μm.

5. The metal wire according to claim 1, wherein
the diameter of the metal wire is at most 13 μm.

6. The metal wire according to claim 1, wherein
the metal wire is a pure tungsten wire.

7. The metal wire according to claim 1, wherein
the metal wire is the tungsten wire, and the tungsten wire is doped with a dopant element that is one of potassium, thorium, and cerium.

8. The metal wire according to claim 7, wherein
a content of the dopant element is at most 0.01 wt % of a mass of the metal wire.

9. The metal wire according to claim 1, wherein
the metal wire is the tungsten alloy wire, and the tungsten alloy wire includes tungsten and a metal element that is one of rhenium, ruthenium, osmium, and iridium.

10. The metal wire according to claim 9, wherein
a content of the metal element is at least 0.1 wt % and at most 10 wt % of a mass of the metal wire.

11. The metal wire according to claim 1, wherein
the metal wire is used as a core wire of a saw wire.

12. The metal wire according to claim 1, wherein
the metal wire is used as a wire of a screen mesh.

* * * * *